US011261869B2

(12) United States Patent
Cramer et al.

(10) Patent No.: US 11,261,869 B2
(45) Date of Patent: Mar. 1, 2022

(54) MOTOR VEHICLE VACUUM PUMP ARRANGEMENT

(71) Applicant: PIERBURG PUMP TECHNOLOGY GMBH, Neuss (DE)

(72) Inventors: Sebastian Cramer, Pulheim (DE); Nabil Salim Al-Hasan, Korschenbroich (DE); Daniel Mueller, Hilden (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 52 days.

(21) Appl. No.: 16/311,168

(22) PCT Filed: Jun. 22, 2016

(86) PCT No.: PCT/EP2016/064429
§ 371 (c)(1),
(2) Date: Dec. 19, 2018

(87) PCT Pub. No.: WO2017/220141
PCT Pub. Date: Dec. 28, 2017

(65) Prior Publication Data

US 2019/0323506 A1 Oct. 24, 2019

(51) Int. Cl.
*F04C 29/12* (2006.01)
*F04C 18/344* (2006.01)
(Continued)

(52) U.S. Cl.
CPC ..... *F04C 29/128* (2013.01); *F04C 18/344* (2013.01); *F04C 25/02* (2013.01);
(Continued)

(58) Field of Classification Search
CPC .. F04C 29/128; F04C 18/344; F04C 2250/20; F04C 2220/12; F04C 29/12; F04C 25/02;
(Continued)

(56) References Cited

U.S. PATENT DOCUMENTS 2,772,637 A * 12/1956 Doble ..... F04C 5/00 418/154
3,459,275 A 8/1969 Prillwitz et al.
(Continued)

FOREIGN PATENT DOCUMENTS

CN 101676563 A 3/2010
CN 102878080 A 1/2013
(Continued)

OTHER PUBLICATIONS

Full Machine Translation of Japanese Patent JP 2012-87701 to Nissin published May 10, 2012, provided in Applicant's IDS.*
(Continued)

*Primary Examiner* — Bryan M Lettman
*Assistant Examiner* — Dnyanesh G Kasture
(74) *Attorney, Agent, or Firm* — Norman B. Thot

(57) ABSTRACT

An electrical motor vehicle vacuum pump arrangement includes a housing assembly, a pump apparatus arranged therein, a drive motor, and a sound dampener. The housing assembly includes an inlet and an outlet opening arrangement. The pump apparatus includes a pump rotor housing with an inlet- and an outlet-side face wall, and a pump rotor housing part arranged therebetween. The inlet- and the outlet-side face wall and the pump rotor housing part enclose a pump rotor chamber with a pump rotor arranged therein. The drive motor is arranged in the housing assembly. The drive motor includes a motor rotor and a motor stator. The sound damper includes a first and a second sound damping chamber, and a sound dampener element. The first sound damping chamber is connected to the pump rotor chamber and to the second sound damping chamber. The second sound damping chamber is connected to the outlet opening arrangement.

17 Claims, 2 Drawing Sheets

(51) Int. Cl.
*F04C 25/02* (2006.01)
*F04C 29/06* (2006.01)

(52) U.S. Cl.
CPC ..... *F04C 29/065* (2013.01); *F04C 29/126* (2013.01); *F04C 2220/12* (2013.01); *F04C 2250/20* (2013.01)

(58) Field of Classification Search
CPC ..... F04C 29/065; F04C 29/066; F04C 15/06; F04C 29/06; F04C 29/068; F04C 2240/806; F04C 2250/10; F04C 2250/101; F04C 2220/10; F04C 2210/221; F04B 39/0027; F04B 39/0055; F04B 39/0061; F04B 39/0072; F04B 53/001; F04B 53/002; F04B 53/003; F04B 53/004; F04B 53/16
See application file for complete search history.

(56) References Cited

U.S. PATENT DOCUMENTS 3,642,095 A * 2/1972 Fujii ..... F01N 1/10 181/271
4,171,016 A * 10/1979 Kempton ..... E21B 43/124 166/105
5,342,183 A * 8/1994 Rafalovich ..... F04C 29/12 418/15
6,872,065 B1 * 3/2005 Shimada ..... F04C 29/061 418/259
2001/0035686 A1 * 11/2001 Hwang ..... H02K 9/00 310/12.29
2010/0319798 A1 * 12/2010 Lim ..... F01C 21/108 137/899
2011/0171041 A1 7/2011 Zhao et al.
2012/0060683 A1 * 3/2012 Peters ..... F04C 25/02 91/468
2014/0161640 A1 6/2014 Geue et al.
2015/0260088 A1 * 9/2015 Jeng ..... F02B 53/04 418/1
2016/0017885 A1 1/2016 Al-Hasan et al.
2019/0330986 A1 * 10/2019 Anderson ..... F01D 5/188

FOREIGN PATENT DOCUMENTS

CN 102943759 A 2/2013
CN 103953543 A 7/2014
DE 3903054 C2 * 10/1993 ..... F04C 29/065
DE 10 2010 029 551 A1 12/2011
EP 2 853 748 A1 4/2015
JP 2012-87701 A 5/2012
JP 2016-44606 A 4/2016
KR 10-2015-0067657 A 6/2015
WO WO 2014/135202 A1 9/2014

OTHER PUBLICATIONS

Machine Translation of German Patent DE 3903054 C2 to Ono, Mitsuya published Oct. 7, 1993.*

* cited by examiner

MOTOR VEHICLE VACUUM PUMP ARRANGEMENT

CROSS REFERENCE TO PRIOR APPLICATIONS

This application is a U.S. National Phase application under 35 U.S.C. § 371 of International Application No. PCT/EP2016/064429, filed on Jun. 22, 2016. The International Application was published in German on Dec. 28, 2017 as WO 2017/220141 A1 under PCT Article 21(2).

FIELD

The present invention relates to an electrical motor vehicle vacuum pump arrangement having a housing assembly with an inlet opening arrangement and an outlet opening arrangement, which housing assembly has a pump apparatus and a drive motor, wherein the pump apparatus has a pump rotor housing composed of an inlet-side and an outlet-side face wall and a pump rotor housing part arranged therebetween, which enclose a pump rotor chamber in which a pump rotor is provided, wherein the drive motor has a motor rotor and a motor stator, wherein a sound damping element for noise reduction is provided, wherein the sound damping element has at least two sound damping chambers connected in series, wherein the first sound damping chamber is fluidically connected to the pump rotor chamber via a first connecting arrangement and is fluidically connected to the second sound damping chamber via a second connecting arrangement, and wherein the second sound damping chamber is fluidically connected to the outlet opening arrangement.

Independent of the operating condition of an internal combustion engine in a motor vehicle, an electrically driven motor vehicle vacuum pump generates an absolute negative pressure of, for example, 100 millibars which is required to operate, for example, a pneumatic brake force booster and/or other pneumatically operated ancillary units. The electrical capacity of the drive motor typically lies in the range of 100 W for small vacuum pumps and several 100 W for large vacuum pumps in the case of an electrical motor vehicle vacuum pump arrangement. Depending on the pumping capacity and the rotational speed of the pump apparatus, the sound emissions may be so high that extensive measures for sound damping and/or for forming an acoustic barrier must be taken. An example of an electrical vacuum pump is described in WO 2014/135202 A1 where the setup is, however, very complex because of the sound damping element used which requires a relatively large installation space.

SUMMARY

An aspect of the present invention is to provide an electrical motor vehicle vacuum pump with low sound emissions where the above-mentioned drawbacks are avoided in a simple and inexpensive manner.

In an embodiment, the present invention provides an electrical motor vehicle vacuum pump arrangement which includes a housing assembly, a pump apparatus, a drive motor, and a sound dampener. The housing assembly comprises an inlet opening arrangement and an outlet opening arrangement. The pump apparatus is arranged in the housing assembly. The pump apparatus comprises a pump rotor housing which comprises an inlet-side face wall, an outlet-side face wall, and a pump rotor housing part arranged between the inlet-side face wall and the outlet-side face wall. The inlet-side face wall, the outlet-side face wall, and the pump rotor housing part are arranged to enclose a pump rotor chamber in which a pump rotor is arranged. The drive motor is arranged in the housing assembly. The drive motor comprises a motor rotor and a motor stator. The sound dampener is configured to provide a noise reduction. The sound damper comprises a first sound damping chamber and a second sound damping chamber which are connected in series, and a sound dampener element. The first sound damping chamber is fluidically connected to the pump rotor chamber via a first connecting arrangement. The first sound damping chamber is fluidically connected to the second sound damping chamber via a second connecting arrangement. The second sound damping chamber is fluidically connected to the outlet opening arrangement. The sound dampener element is provided as a bore arrangement for at least one of the second connecting arrangement and the outlet opening arrangement.

BRIEF DESCRIPTION OF THE DRAWINGS

The present invention is described in greater detail below on the basis of embodiments and of the drawings in which.

DETAILED DESCRIPTION

The present invention provides at least one sound damping element in the form of a bore arrangement for the second connecting arrangement and/or the outlet opening arrangement. Sound emissions can be considerably reduced via such a simple measure. The vacuum pump of the present invention thus requires a smaller installation space and is more inexpensive to manufacture.

According to an embodiment of the present invention, the first sound damping chamber can, for example, be integrated in the outlet-side face wall. The first connecting arrangement can also be composed of a first pump outlet having a check valve and a second pump outlet which is staggered as seen in the direction of rotation of the pump rotor.

The first sound damping chamber can advantageously be defined by a cover element arranged on a side of the outlet-side face wall facing away from the pump rotor, wherein the second connecting arrangement is configured as a groove in the outlet-side face wall.

In an embodiment of the present invention which involves little installation space, the housing assembly can, for example, comprise an end cover element which encompasses the outlet-side face wall so that a second sound damping chamber is defined.

Due to the fact that the outlet opening arrangement is provided as a bore arrangement in the form of successive bore elements in the outlet-side face wall, existing housing parts can be used for the outlet opening in the pump rotor housing part and in the inlet-side face wall so as to provide a considerable sound damping due to the reflection properties of the bore arrangement. The sound damping can further be improved by the bore element in the inlet-side face wall flaring towards the outlet side.

The pump apparatus can advantageously be arranged coaxially to the drive motor, wherein a rotor shaft of the drive rotor is supported in the inlet-side face wall via bearing.

It is also favorable with regard to the installation space when the inlet opening arrangement is provided in the inlet-side face wall. All types of rotatory pump apparatus are generally suitable. The pump apparatus can, for example, be a vane-type pump apparatus.

The present invention is explained in greater detail below under reference to the drawings.

Figure 1:
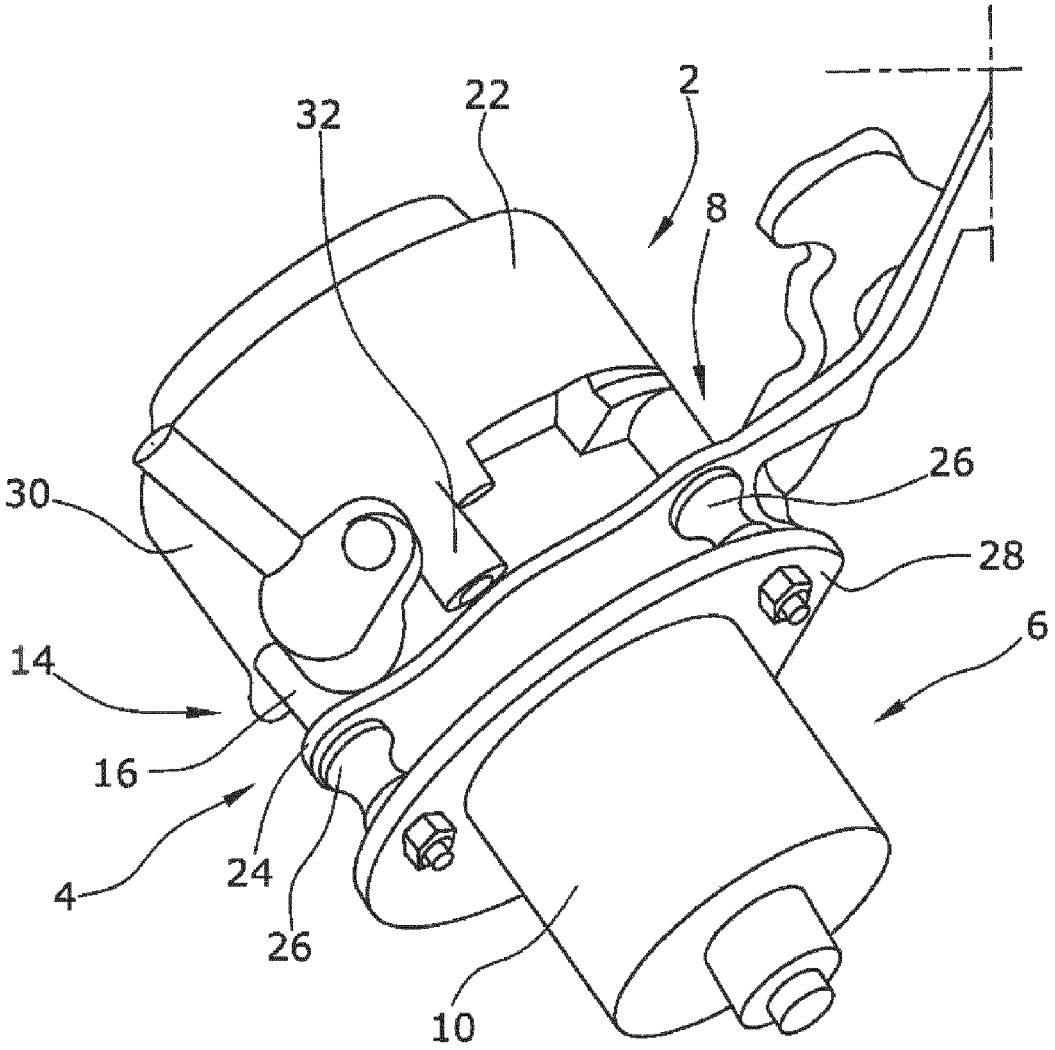
FIG. 1 shows a perspective view of an electrical motor vehicle vacuum pump arrangement according to the present invention.
Figure 2:
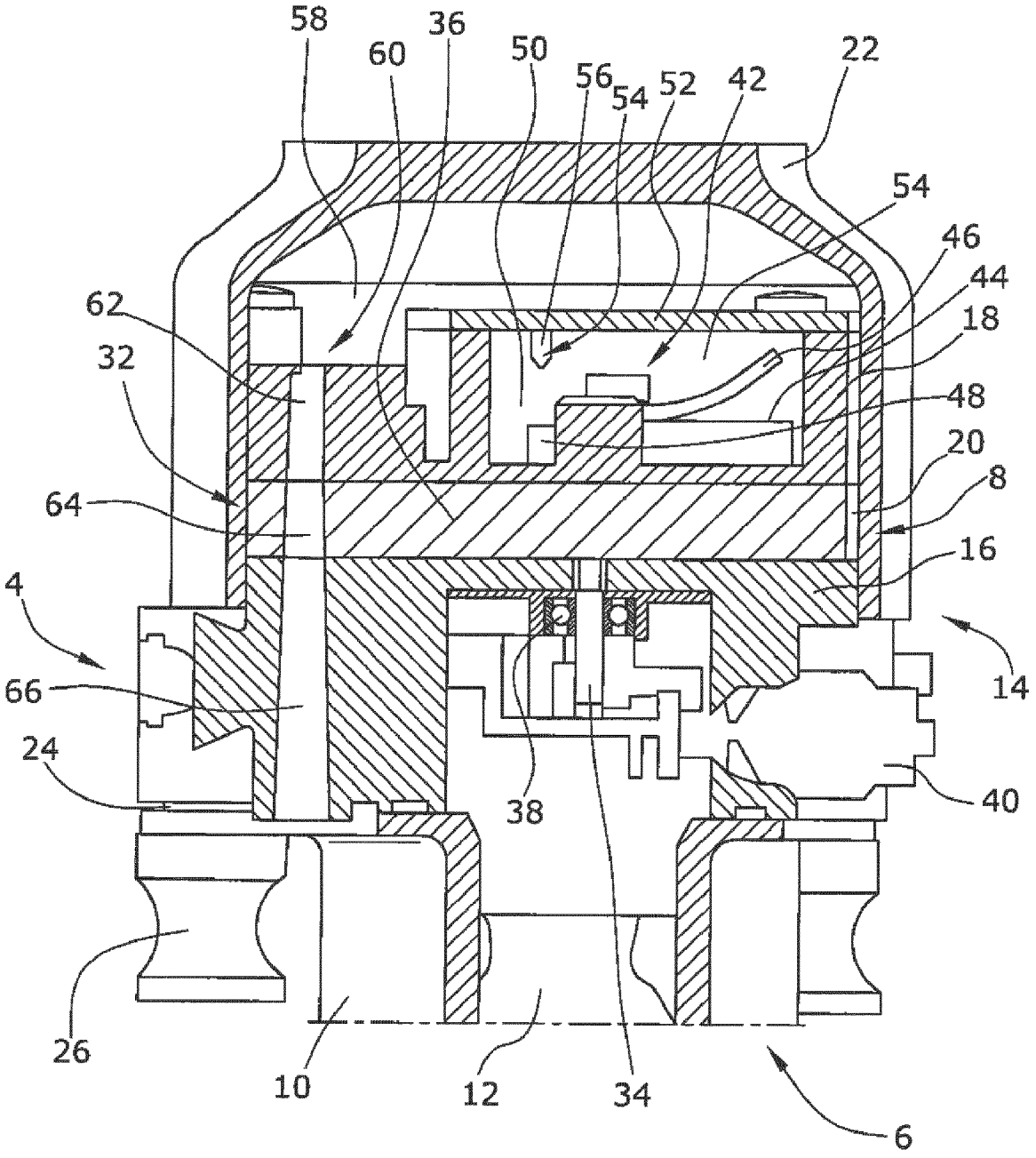
FIG. 2 shows a sectional view of a pump apparatus and a portion of the drive motor of the motor vehicle vacuum pump arrangement of FIG. 1.

FIGS. 1 and 2 show an electrical motor vehicle vacuum pump arrangement 2 which serves, for example, to provide a vacuum with an absolute pressure of 100 mbar and less in a motor vehicle. The vacuum is mainly used as potential energy for actuating elements, for example, for a pneumatic brake force booster or other pneumatic motor vehicle actuators. An electric drive for motor vehicle vacuum pumps is increasingly required since the internal combustion engine of the motor vehicle does not permanently run during the vehicle operation.

The electrical motor vehicle vacuum pump arrangement 2 is essentially composed of a housing assembly 4 comprising a drive motor 6 and a pump apparatus 8. The drive motor 6 is provided in a pot-shaped motor housing 10 and conventionally comprises a drive rotor 12 (see FIG. 2) and a drive motor stator (not shown in the drawings). The pump apparatus 8 comprises a pump rotor housing 14 composed of an inlet-side face wall 16, an outlet-side face wall 18, and a pump rotor housing part 20 arranged therebetween (see in particular FIG. 2). The housing assembly 4 further includes an end cover element 22 which encompasses the outlet-side face wall 18 and the pump rotor housing part 20 and engages the inlet-side face wall 16 in a form-fit manner. The pump rotor housing 14 having the end cover element 22 is connected to the pot-shaped motor housing 10 via a first flange part 24. The first flange part 24 adjoins a second flange part 28 with damping bodies 26 being arranged therebetween, via which second flange part 28 the electrical motor vehicle vacuum pump arrangement 2 can be connected to a vehicle body component of a motor vehicle.

FIG. 1 also shows an inlet opening arrangement 30 in the form of a plastic pipe element which is provided in the inlet-side face wall 16 and via which air to be discharged from a motor vehicle actuator is to be fed to the pump apparatus 8. Air compressed by the pump apparatus 8 is discharged into the atmosphere via an outlet opening arrangement 32.

FIG. 2 shows a sectional view of the pump apparatus 8 as well as a portion of the drive motor 6. As already stated above, the drive motor 6 comprises a drive rotor 12 which is fastened to a drive rotor shaft 34 for rotation therewith, wherein the drive rotor shaft 34 also serves as a rotor shaft for a pump rotor 36 provided in a pump rotor chamber 35 of the pump rotor housing 14. The drive rotor shaft 34 is here supported in the inlet-side face wall 16 via a bearing 38 which is here configured as a roller bearing.

Power is supplied to the drive motor 6 via an electrical connecting cable 40. The air taken in through the inlet opening arrangement 30 and compressed in the pump rotor chamber 35 by the pump rotor 36 (which is configured as a vane-type rotor), is discharged from the pump rotor chamber 35 via a first connecting arrangement 42. The first connecting arrangement 42 is here conventionally composed of a first pump outlet 44 which includes a check valve 46 for noise reduction, and a second pump outlet 48 which is staggered, as seen in the direction of rotation of the pump rotor 36. Via this first connecting arrangement 42, the compressed air is fed into a first sound damping chamber 50 which is integrated in the outlet-side face wall 18. For this purpose, the first sound damping chamber 50 comprises a cover element 52 on the side of the outlet-side face wall 18 facing away from the pump rotor 36. The second connecting arrangement 54 is created via this cover element 52, which second connecting arrangement 54 is essentially configured as a groove 56 in the outlet-side face wall 18. The compressed air damped in the first sound damping chamber 50 is fed to the second sound damping chamber 58 via the second connecting arrangement 54. The sound damping chamber 58 is essentially created by the end cover element 22 encompassing the outlet-side face wall 18 in a fluid-tight manner. The compressed air is then discharged into the atmosphere via the outlet opening arrangement 32 which is configured as a bore arrangement 60. The bore arrangement 60 is here made up of successive bore elements 62, 64 and 66. Bore element 62 is provided in the outlet-side face wall 18, bore element 64 is provided in the pump rotor housing part 20, the bore element 66 is provided in the inlet-side face wall 16. A further damping of the airborne sound can be achieved since the bore arrangement 60 thus forms an elongate pipe. The bore element 66 is also flared towards the outlet side, whereby a further sound reduction is realized due to a pressure change.

It should be appreciated that according to the configuration of the electrical motor vehicle vacuum pump arrangement 2, the second connecting arrangement 54 may be additionally or solely provided as the bore arrangement.

The present invention is not limited to embodiments described herein; reference should be had to the appended claims.

What is claimed is:

1. An electrical motor vehicle vacuum pump arrangement comprising:

a housing assembly comprising an inlet opening arrangement and an outlet opening arrangement;

a pump apparatus arranged in the housing assembly, the pump apparatus comprising a pump rotor housing which comprises an inlet-side face wall, an outlet-side face wall, and a pump rotor housing part arranged between the inlet-side face wall and the outlet-side face wall, the inlet-side face wall, the outlet-side face wall, and the pump rotor housing part being arranged to enclose a pump rotor chamber in which a pump rotor is arranged;

a drive motor arranged in the housing assembly, the drive motor comprising a motor rotor and a motor stator; and a sound dampener configured to provide a noise reduction, the sound damper comprising, a first sound damping chamber and a second sound damping chamber connected in series, wherein, the first sound damping chamber is fluidically connected to the pump rotor chamber via a first connecting arrangement, the first sound damping chamber is fluidically connected to the second sound damping chamber via a second connecting arrangement, and the second sound damping chamber is fluidically connected to the outlet opening arrangement, and a sound dampener element provided as a bore arrangement for the outlet opening arrangement, the bore arrangement comprising bore elements which are respectively arranged in the outlet-side face wall, in the pump rotor housing part, and in the inlet-side face wall, wherein the bore element arranged in the inlet-side face wall is flared towards an outlet side, and wherein the outlet opening arrangement of the bore arrangement opens to an exterior of the electrical motor vehicle vacuum pump arrangement.

2. The electrical motor vehicle vacuum pump arrangement as recited in claim 1, wherein the first sound damping chamber is integrated in the outlet-side face wall.

3. The electrical motor vehicle vacuum pump arrangement as recited in claim 2, wherein the first connecting arrangement comprises, a first pump outlet which comprises a check valve, and a second pump outlet which is offset with regard to the first pump outlet when viewed from above or below the pump rotor along an axis of rotation of the pump rotor.

4. The electrical motor vehicle vacuum pump arrangement as recited in claim 1, wherein, the first sound damping chamber is created by a cover element arranged on a side of the outlet-side face wall facing away from the pump rotor, and the second connecting arrangement is configured as a groove in the outlet-side face wall.

5. The electrical motor vehicle vacuum pump arrangement as recited in claim 1, wherein the housing assembly further comprises an end cover element which is configured to encompass the outlet-side face wall so as to define the second sound damping chamber.

6. The electrical motor vehicle vacuum pump arrangement as recited in claim 1, further comprising:

a bearing, wherein, the pump apparatus is arranged coaxially to the drive motor, and the motor rotor comprises a rotor shaft which is supported in the inlet-side face wall via the bearing.

7. The electrical motor vehicle vacuum pump arrangement as recited in claim 1, wherein the inlet opening arrangement is arranged in the inlet-side face wall.

8. The electrical motor vehicle vacuum pump arrangement as recited in claim 1, wherein the pump apparatus is a vane pump apparatus.

9. An electrical motor vehicle vacuum pump arrangement comprising:

a housing assembly comprising an inlet opening arrangement and an outlet opening arrangement;

a pump apparatus arranged in the housing assembly, the pump apparatus comprising a pump rotor housing which comprises an inlet-side face wall, an outlet-side face wall, and a pump rotor housing part arranged between the inlet-side face wall and the outlet-side face wall, the inlet-side face wall, the outlet-side face wall, and the pump rotor housing part being arranged to enclose a pump rotor chamber in which a pump rotor is arranged;

a drive motor arranged in the housing assembly, the drive motor comprising a motor rotor and a motor stator; and a sound dampener configured to provide a noise reduction, the sound damper comprising, a first sound damping chamber and a second sound damping chamber connected in series, wherein, the first sound damping chamber is fluidically connected to the pump rotor chamber via a first connecting arrangement, the first sound damping chamber is fluidically connected to the second sound damping chamber via a second connecting arrangement, and the second sound damping chamber is fluidically connected to the outlet opening arrangement, and a sound dampener element provided as a bore arrangement for the outlet opening arrangement, the bore arrangement comprising bore elements which are respectively arranged in the outlet-side face wall, in the pump rotor housing part, and in the inlet-side face wall, wherein the bore elements are configured to continuously flare towards an outlet side through each of the outlet-side face wall, the pump rotor housing part, and the inlet-side face wall, and wherein the outlet opening arrangement of the bore arrangement opens to an exterior of the electrical motor vehicle vacuum pump arrangement.

10. The electrical motor vehicle vacuum pump arrangement as recited in claim 9, wherein the first sound damping chamber is integrated in the outlet-side face wall.

11. The electrical motor vehicle vacuum pump arrangement as recited in claim 10, wherein the first connecting arrangement comprises, a first pump outlet which comprises a check valve, and a second pump outlet which is offset with regard to the first pump outlet when viewed when viewed from above or below the pump rotor along an axis of rotation of the pump rotor.

12. The electrical motor vehicle vacuum pump arrangement as recited in claim 9, wherein, the first sound damping chamber is created by a cover element arranged on a side of the outlet-side face wall facing away from the pump rotor, and the second connecting arrangement is configured as a groove in the outlet-side face wall.

13. The electrical motor vehicle vacuum pump arrangement as recited in claim 9, wherein the housing assembly further comprises an end cover element which is configured to encompass the outlet-side face wall so as to define the second sound damping chamber.

14. An electrical motor vehicle vacuum pump arrangement comprising:

a housing assembly comprising an inlet opening arrangement, an outlet opening arrangement, and an end cover element;

a pump apparatus arranged in the housing assembly, the pump apparatus comprising a pump rotor housing which comprises an inlet-side face wall, an outlet-side face wall, and a pump rotor housing part arranged between the inlet-side face wall and the outlet-side face wall, the inlet-side face wall, the outlet-side face wall, and the pump rotor housing part being arranged to enclose a pump rotor chamber in which a pump rotor is arranged;

a drive motor arranged in the housing assembly, the drive motor comprising a motor rotor and a motor stator; and a sound dampener configured to provide a noise reduction, the sound damper comprising, a first sound damping chamber and a second sound damping chamber connected in series, wherein, the first sound damping chamber is fluidically connected to the pump rotor chamber via a first connecting arrangement, the first sound damping chamber is fluidically connected to the second sound damping chamber via a second connecting arrangement, and the second sound damping chamber is fluidically connected to the outlet opening arrangement, and a sound dampener element provided as a bore arrangement for the outlet opening arrangement, the bore arrangement comprising bore elements which are respectively arranged in the outlet-side face wall, in the pump rotor housing part, and in the inlet-side face wall, wherein the bore elements are configured to continuously flare towards an outlet side through each of the outlet-side face wall, the pump rotor housing part, and the inlet-side face wall, and wherein the outlet opening arrangement of the bore arrangement opens to an exterior of the electrical motor vehicle vacuum pump arrangement, wherein, the end cover element of the housing assembly is configured to encompass the outlet-side face wall, the pump rotor housing part, and at least a part of the inlet-side face wall, and the second sound damping chamber is defined by the end cover element encompassing the outlet-side face wall.

15. The electrical motor vehicle vacuum pump arrangement as recited in claim 14, wherein the first sound damping chamber is integrated in the outlet-side face wall.

16. The electrical motor vehicle vacuum pump arrangement as recited in claim 15, wherein the first connecting arrangement comprises, a first pump outlet which comprises a check valve, and a second pump outlet which is offset with regard to the first pump outlet when viewed when viewed from above or below the pump rotor along an axis of rotation of the pump rotor.

17. The electrical motor vehicle vacuum pump arrangement as recited in claim 14, wherein, the first sound damping chamber is created by a cover element arranged on a side of the outlet-side face wall facing away from the pump rotor, and the second connecting arrangement is configured as a groove in the outlet-side face wall.

* * * * *